US006308562B1

(12) United States Patent
Abdallah et al.

(10) Patent No.: US 6,308,562 B1
(45) Date of Patent: Oct. 30, 2001

(54) TECHNIQUE FOR SIGNAL DETECTION USING ADAPTIVE FILTERING IN MUD PULSE TELEMETRY

(75) Inventors: Ali H. Abdallah, Houston; Mark S. Beattie, Katy, both of TX (US)

(73) Assignee: W-H Energy Systems, Inc., Houston, TX (US)

( * ) Notice: Subject to any disclaimer, the term of this patent is extended or adjusted under 35 U.S.C. 154(b) by 0 days.

(21) Appl. No.: 09/469,989

(22) Filed: Dec. 22, 1999

(51) Int. Cl.[7] ..... A61F 11/06; E21B 47/00; G01V 1/00; H04R 3/02

(52) U.S. Cl. ..... 73/152.18; 73/152.22; 73/152.32; 73/152.04; 73/602; 73/624; 340/855.6; 340/856.4

(58) Field of Search ..... 73/152.18, 152.19, 73/152.22, 152.32, 152.58, 152.04, 152.16, 602, 624, 628; 340/855.6, 854.3, 856.4, 853.2, 606, 310.03

(56) References Cited

U.S. PATENT DOCUMENTS

| | | | | |
|---|---|---|---|---|
| H55 | * | 5/1986 | Ramsey et al. | 73/155 |
| 3,908,454 | * | 9/1975 | Mullins et al. | 73/155 |
| 4,208,906 | * | 6/1980 | Roberts, Jr. | 73/155 |
| 4,286,461 | * | 9/1981 | Bres et al. | 73/155 |
| 4,295,366 | * | 10/1981 | Gibson et al. | 73/155 |
| 4,299,123 | * | 11/1981 | Dowdy | 73/155 |
| 4,520,665 | * | 6/1985 | Cordier et al. | 73/155 |
| 4,532,812 | * | 8/1985 | Birchak | 73/861.27 |

(List continued on next page.)

OTHER PUBLICATIONS

U.S. application No. 09/415,592, Beattie et al. filed Oct. 8, 1992, pending.

*Adaptive Signal Processing*, B. Widrow and S.D. Stearns, ©1985, pp. 349–354.

*Theory and Practice of Recursive Identification*, L. Ljung and T. Soderstrom, ©1983, pp. 390–402.

*New Result In Linear Filtering and Prediction Theory*, Journal of Basic Engineering, R.E. Kalman and R.S. Bucy, Mar. 1961, pp. 95–108.

*A Fast Sequential Algorithm For Least–Squares Filtering and Prediction*, IEEE Transactions On Acoustics, Speech, and Signal Processing, vol. ASSP–31, No. 6, George Carayannis et al., ©1983, pp. 1394–1400.

*Adaptive Noise Cancelling: Principals and Applications*, Proceedings of the IEEE, vol. 63, No. 12, Bernard Widrow et al., Dec. 1975, pp. 1692–1719.

Adaptive Filters, C.F.N. Cowan and P.M Grant, Chapter 5, pp. 91–144.

Optimal Filtering, Brian D.O. Anderson and John B. Moore, ©1979, Chapter 10, pp. 267–287.

Optimal Signal Processing: An Introduction, Sophocles J. Orfanidis, ©1988, Chapter 7.

*Primary Examiner*—Daniel S. Larkin
*Assistant Examiner*—David J. Wiggins
(74) *Attorney, Agent, or Firm*—Akin, Gump, Strauss, Hauer & Feld, LLP

(57) ABSTRACT

A mud pulse telemetry adaptive noise canceler (ANC) employs a primary transducer and a reference transducer downstream from a position of the primary transducer. The primary transducer receives a primary signal based on a combination of a transmitted pulse and a reflected pulse, and the reference transducer receives a reference signal based on the transmitted pulse. The ANC linearly relates the secondary signal to the primary signal by means of a fast recursive least squares algorithm and calculates a set of weighting coefficients. The finite impulse response (FIR) filter of the ANC uses the set of weighting coefficients to adaptively noise cancel correlated portions between the primary signal and the secondary signal to produce an ANC output signal based on uncorrelated portions between the primary signal and the secondary signal.

23 Claims, 8 Drawing Sheets

U.S. PATENT DOCUMENTS 4,733,233 * 3/1988 Grosso et al. ..... 340/861
4,733,380 * 3/1988 Havira ..... 367/35
4,905,203 * 2/1990 Sims et al. ..... 367/25
4,912,683 * 3/1990 Katahara et al. ..... 367/25
4,945,761 * 8/1990 Lessi ..... 73/151
4,947,683 * 8/1990 Minear et al. ..... 73/155
5,386,472 * 1/1995 Pfaff et al. ..... 381/71
5,555,503 * 9/1996 Kyrtsos et al. ..... 364/449
5,940,519 * 8/1999 Kuo ..... 381/71.11

* cited by examiner

TECHNIQUE FOR SIGNAL DETECTION USING ADAPTIVE FILTERING IN MUD PULSE TELEMETRY

BACKGROUND OF THE INVENTION

1. Field of the Invention

The present invention generally relates to a method of processing mud pulse telemetry and, more specifically, to a method of analyzing mud pulse telemetry signals using adaptive noise cancellation techniques.

2. Description of the Related Art

Typical petroleum drilling operations employ a number of techniques to gather information such as the size and direction of a bore hole and the types of materials through which a drillpipe and drill bit are drilling. Originally, the drillpipe and drill bit needed to be pulled from the bore hole and then instruments inserted into the hole in order to collect information about down hole conditions. This technique, or "wireline logging," is expensive in terms of both money and time; so techniques called Measurement-While-Drilling (MWD) and Logging-While-Drilling (LWD) were developed. LWD collects the same type of information as wireline logging while MWD also enables a driller to determine the direction of a bore hole during the drilling operation so that the driller can more accurately control the drilling operations. The techniques of the disclosed embodiment apply to both MWD and LWD and, for the purpose of the disclosed embodiment, they will be referred to together as "MWD/LWD."

A problem common to MWD/LWD is how to transmit data from the bottom of a bore hole to a point on the surface where it can be collected and processed. A typical technique for this type of data transmission is mud pulse telemetry. During the drilling operation, drilling mud is pumped from a mud pump downward through the drillpipe and emerges near the drill bit at the bottom of the drill hole. This mud cools and lubricates the drill bit, carries rock cuttings to the surface where they can be analyzed and prevents the walls of the bore hole from collapsing. In mud pulse telemetry, a transmission device, or "pulser," such as an electo-mechanical pulser or a mud siren near the drill bit generates a signal that is transmitted upward to the surface through the downward traveling column of mud. A transducer, typically at the surface, receives the signal and transmits it to a signal processor. The signal processor then decodes and analyzes the signal to provide real-time information about the drilling operation to the driller.

One problem with decoding and analyzing the signal is that noise seen by the transducer, generated by the drilling operation, obscures the signal. There are a number of potential sources of noise generated during MWD/LWD. Noise may be introduced by the turning of the drill bit and drillpipe and/or from the mud pump used to force the mud into the drillpipe. Another source of noise is a reflected signal that is created when the original signal hits a pulsation dampener, or "desurger," near the top of the mud column and is reflected back down the hole. In addition to noise, the MWD/LWD signal may be degraded by the type of mud, the mud pressure, the length and joints of the drillpipe, and the desurger.

To obtain reliable MWD/LWD signal decoding, slow data transmission rates are typically used (about 1 bit per second) in order to sustain reasonable signal amplitude, and therefore, achieve an acceptable signal-to-noise (S/N) ratio. If data transmission rates are increased, clock tracking and timing recovery, signal amplitude, and the S/N ratio between the pulser and transducer become very sensitive and difficult to maintain due to the nature of the drilling operations, thus, decreasing the reliability of the MWD/LWD data.

Recently, a technique that employs two transducers has been developed to ameliorate the effects of the noise sources on the signal. In general, the signal at a second transducer is subtracted from the signal at a first transducer. Specifically, the first transducer is placed such that a leading edge of an upward traveling signal can be sampled before a downward traveling signal caused by the reflection of the upward traveling signal arrives at the first transducer. The second transducer is placed either close to or at the point where the upward traveling signal is reflected and thus is, its output in essence, the upward traveling signal uncontaminated by the downward traveling reflected signal. One or both of the signals received at the first transducer and the second transducer are time shifted, and the second signal is then subtracted from the first signal. This technique produces a processed signal with more sharply defined leading and trailing edges. Because the information carried by a signal is typically encoded either in the pulse position or the timing and the phase of the signal, more sharply defined leading and trailing edges enable the processed signal to be less obscured by the noise and more easily decoded than a signal in a single-transducer MWD/LWD system.

SUMMARY OF THE INVENTION

A mud pulse telemetry adaptive noise canceler (ANC) is provided to process Measure-While-Drilling/Logging-While-Drilling (MWD/LWD) communication signals to provide information on down hole conditions during a MWD/LWD drilling operation. The ANC employs two transducers, each receiving a succession of signals. A primary transducer, located down hole from both a mud pump and a desurger, receives a primary signal. A reference transducer, located near or, optimally, on the desurger, receives a reference signal. The ANC calculates a best least squares fit between the reference signal and the correlated primary signal and then estimates the phase and magnitude of linearly correlated parts of the MWD/LWD data. The ANC employs a transversal filter structure, or Finite Impulse Response (FIR) filter, in conjunction with a set of coefficients, or weights, calculated or updated continuously in real-time to improve the behavior or performance of the ANC according to desired criteria. In other words, the ANC of the disclosed embodiment determines the phase and amplitude of linearly related counterparts in corresponding primary and reference signals and uses this phase and amplitude information to process a successive signal. In terms of this disclosure, a successive signal is either a primary or reference signal that follows the primary and reference signal, either immediately or later. In the disclosed embodiment, the successive signal is the reference signal; but, in the alternative, the successive signal may be a primary signal. In the alternative, the ANC may also calculate a set of coefficients based upon a finite number of primary and reference signals and then employ this fixed set of coefficients on successive signals.

Thus, the disclosed ANC can actively adapt to changing conditions in a bore hole such as variations in depth and the materials through which a drillpipe and a drill bit are passing. The techniques of the disclosed embodiment enhance data transmission in a variety of noise environments by automatically adjusting in real time to changes in the pressure signal or to noise sources that may be present due to changing drilling conditions. Accordingly, the ANC output contains a sharply defined peak at a leading edge of output pulses of the ANC output and a sharply defined dip at a trailing edge of the output pulses with a frequency that is dependent on the distance between the two transducers. In addition, the generated spikes are time synchronized with the transmitted modulated pulses, thus providing accurate clock tracking and recovery, more reliable signal detection, a better S/N ratio and thus higher data transmission rates.

BRIEF DESCRIPTION OF THE DRAWINGS

A better understanding of the present invention can be obtained when the following detailed description of the invention is considered in conjunction with the following drawings, in which.

DETAILED DESCRIPTION OF THE PREFERRED EMBODIMENT

Figure 1A:
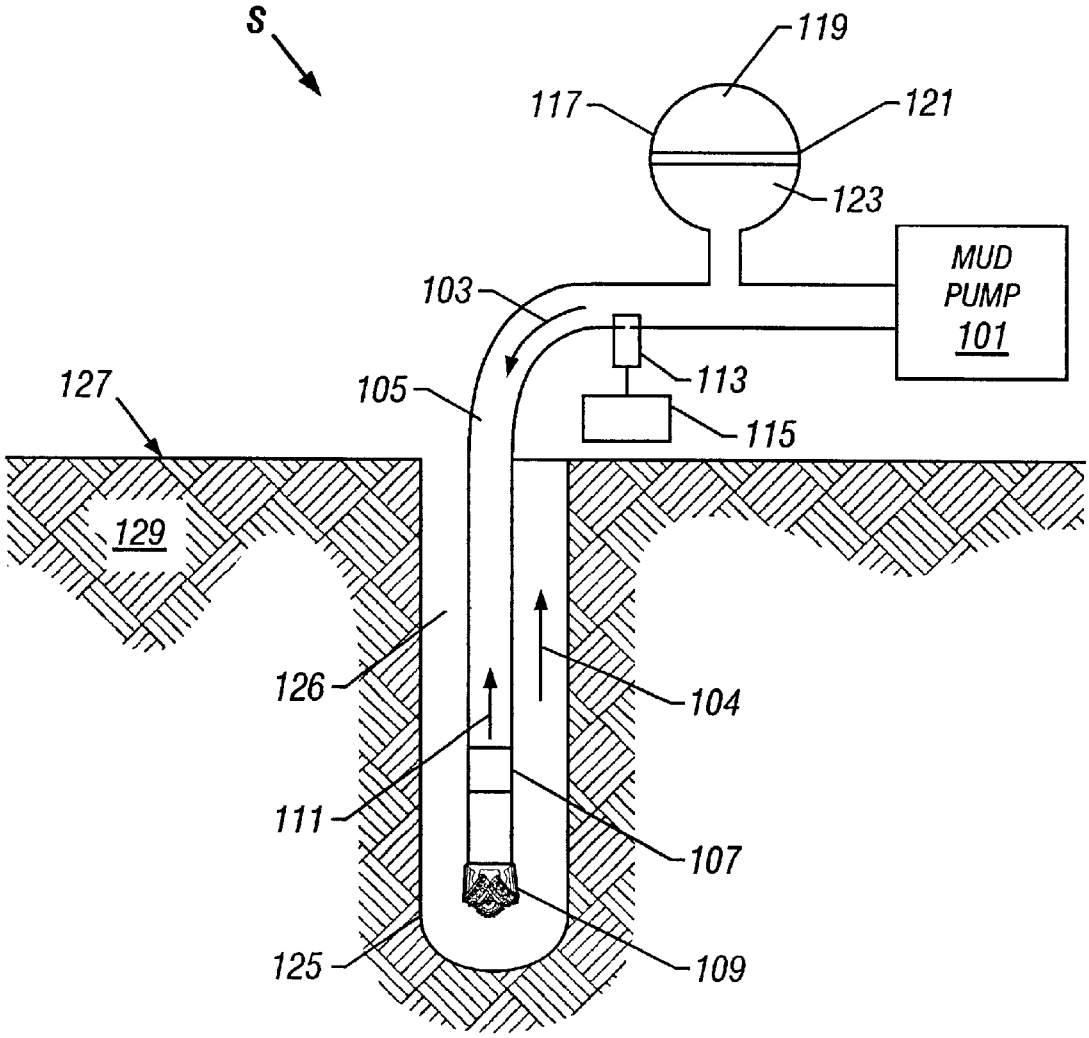
FIG. 1*a* illustrates an exemplary single transducer, Measure-While-Drilling/Logging-While-Drilling (MWD/LWD) system employed in a drilling operation.

Turning now to the drawings, FIG. 1*a* shows an exemplary single-transducer, Measurement-While-Drilling/Logging-While-Drilling (MWD/LWD) system S for processing MWD/LWD telemetry. A mud pump 101 generates a downward-travelling mud flow 103 through a drillpipe, or annulus, 105. The rotation of the drillpipe 105 and a drill bit 109 connected to the drillpipe 105 creates a bore hole 125 in the earth 129. The mud flow 103 emerges from the drill bit 109 into the bore hole 125 and creates an upward-travelling mud flow 104 through an annulus 126, or the space between the drillpipe 105 and the edge of the bore hole 125. A transmission device 107, such as an electo-mechanical pulser or a mud siren, produces an acoustic or pressure wave, or "signal," 111 that travels at the speed of sound in mud toward the earth's surface 127 through the downward-travelling mud flow 103 in the drillpipe 105 and is received or detected at a transducer 113. The transducer 113 is connected to a signal processor 115 that decodes and analyzes the signal 111. In this example, the signal 111 is encoded using pulse position and carries information about drilling parameters and conditions in the drill hole 125 that a driller may use to monitor and control the drilling operation. The signal 111 may instead be encoded using phase and amplitude and the signal 111 may instead be transmitted through and received from the upward travelling mud flow 104 in the annulus 126.

Also included in the MWD/LWD system S is a desurger 117 that evens out the mud flow 103 within the drillpipe 105. A membrane 121 separates the desurger 117 into a mud section 123 and a nitrogen section 119. The desurger 117 acts like an accumulator to smooth outlet pressure generated by the mud pump 101. The use of a single transducer, MWD/LWD system S is well known to those with knowledge in the petroleum drilling arts.

Figure 1B:
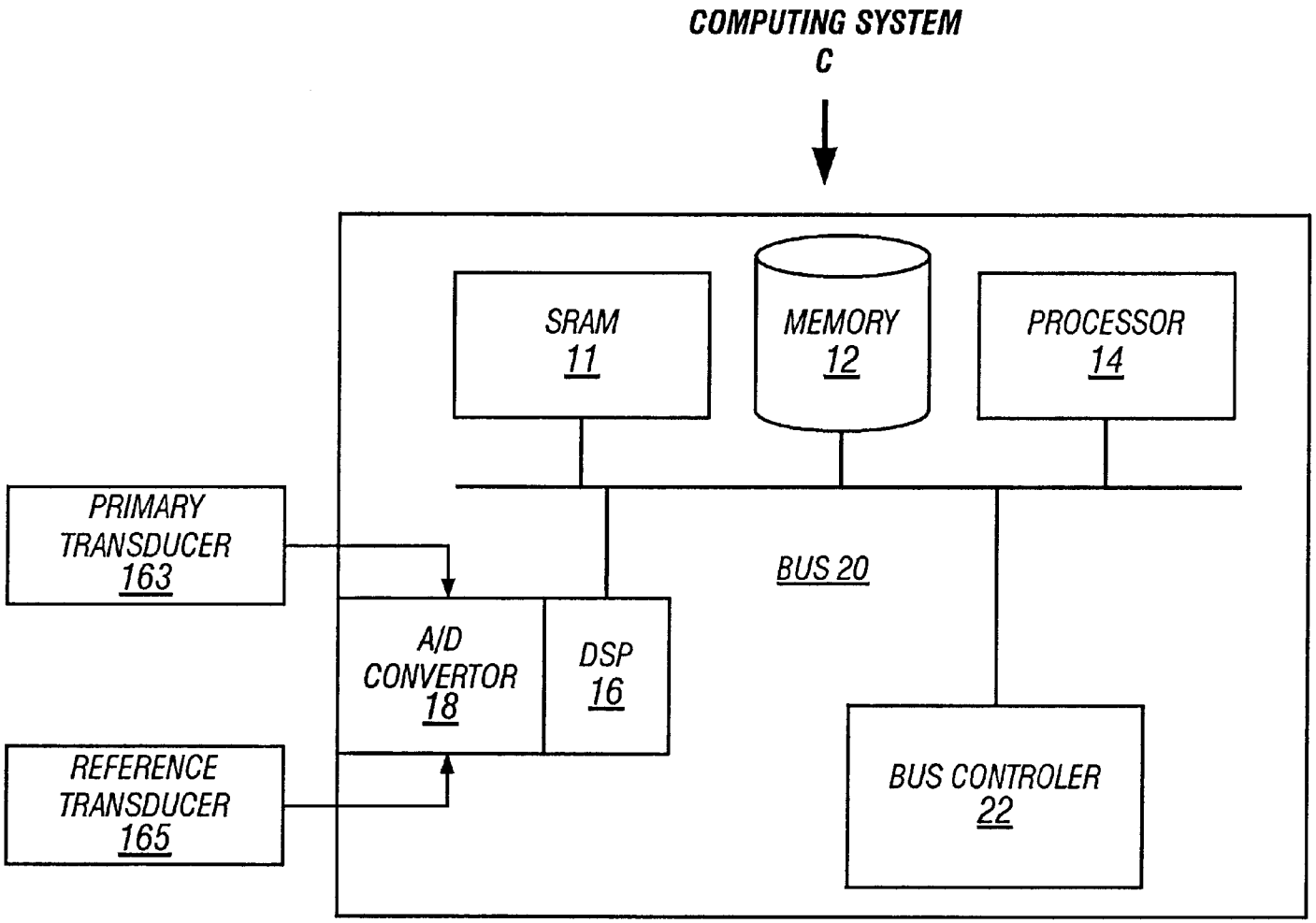
FIG. 1*b* is a block diagram of an exemplary computing system that can implement the techniques of the disclosed embodiment.

Turning now to FIG. 1*b*, illustrated is a block diagram of an exemplary computing system C that can implement the techniques of the disclosed embodiment. The computing system C includes a bus controller 22, a processor 14, synchronous dynamic access memory (SDRAM) 11, an analog-to-digital (A/D) converter 18, a digital signal processing module (DSP) 16 and a memory 12. The memory 12 is non-volatile memory such as a hard disk drive or an EEPROM device. The processor 14, the SDRAM 11, the memory 12, the DSP 16 and the bus controller 22 are coupled to a bus 20.

The computing system C is controlled by an operating system (OS) (not shown) which is stored in one or both of the memory 12 and the SRAM 11 and executes on the processor 14. A primary pressure transducer 163 and a reference pressure transducer 165 are coupled to the A/D converter 18, which is coupled to the DSP 16. Both the primary transducer 163 and the reference transducer 165 are described in more detail below in conjunction with FIG. 4. In this example, the computing system C is a processor-based device programmed to implement the techniques of the disclosed embodiment. Computer code to implement an adaptive noise canceler (ANC) of the disclosed embodiment is stored in one of or both the memory 12 and the SRAM 11 and executed on the processor 14 or the DSP 16. In the alternative, the computing system C may be a personal computer (PC) with a video display and a keyboard enabling human interaction with the computing system C. It should be understood that a specific processor, operating system, memory, bus and certain other hardware and software components are not critical to the techniques of the disclosed embodiments and are used as examples only In the alternative, the techniques of the disclosed embodiment may be incorporated into hard-wired electronic circuits.

Figure 2:
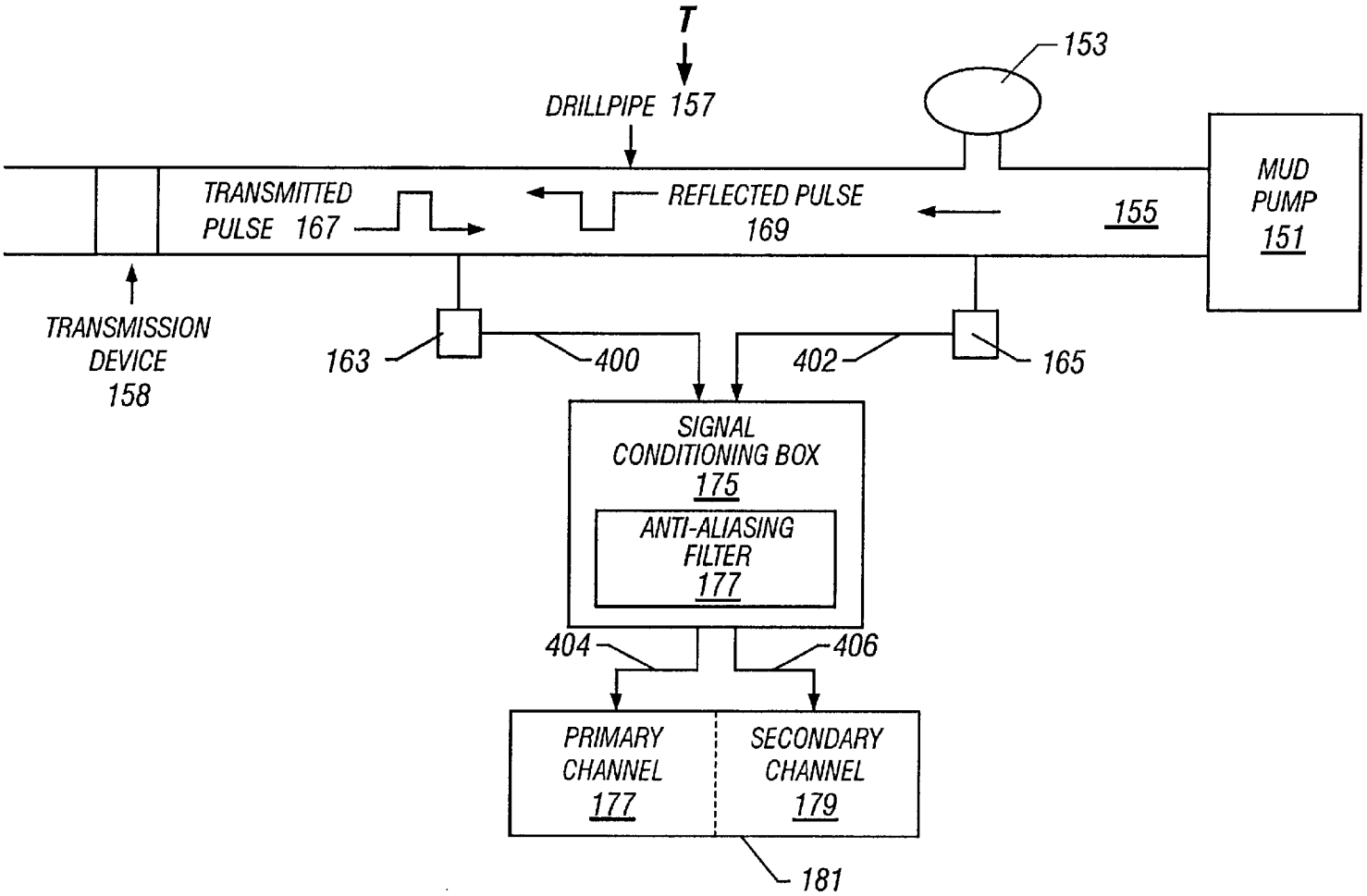
FIG. 2 illustrates an exemplary two-transducer, MWD/LWD system that can employ the techniques of the disclosed embodiment.

Turning now to FIG. 2, illustrated is an exemplary two-transducer, MWD/LWD system T that employs the techniques of the disclosed embodiment to process mud pulse telemetry. The MWD/LWD system T includes a mud pump 151, a drillpipe 157, a mud flow 155 produced by the mud pump 151 through the drillpipe 157, a desurger 153 and a transmission device 158 that are similar in type and function to the mud pump 101, the drillpipe 105, the mud flow 103, the desurger 117, and the transmission device 107 respectively of the single-transducer, MWD/LWD system S (FIG. 1*a*). Some details of the MWD/LWD system T such a drill bit and portions of the desurger 153 that are not critical to the disclosed techniques are omitted for sake of clarity. Unlike the MWD/LWD system S, the MWD/LWD system T includes two transducers, the primary pressure transducer 163, located upstream of the pulser (not shown) and downstream of the desurger 153, and the reference pressure transducer 165, located near or, optimally, on the desurger 153. Both the primary transducer 163 and the reference transducer 165 were first introduced above in conjunction with FIG. 1*b*. Ideally, the primary transducer 163 should be between 50 and 300 feet from the desurger 153; and the reference transducer 165 should be near or on the desurger 153. The primary transducer 163 can also be termed the rig floor transducer 163.

The primary transducer 163 receives a transmitted signal 167, which is generated by the transmission device 158, and a reflected signal 169. It should be understood that both the transmitted signal 167 and the reflected signal 169 contain MWD/LWD data. The reflected signal 169 is created when the transmitted signal 167 reflects from the desurger 153 and is propagated back down hole in the same direction as the mud flow 155. As will be explained below, the characteristics of a signal received at the transducers 163 and 165 differ due to the relative positions of the transducers 163 and 165, the mud pump 151 and the desurger 153.

For example, the signal received at the primary transducer 163 includes both the transmitted pulse 167 and the reflected pulse 169; the signal received at the reference transducer 165 includes the transmitted pulse 167 only due to the reference transducer's 165 location either near or on the desurger 153. The techniques of the disclosed embodiment take advantage of the difference between the signal received at the primary transducer 163 and the signal received at the reference transducer 165 to facilitate the processing of the transmitted signal 167. Examples of suitable pressure transducers that may serve as the primary and reference transducers 163 and 164 are the Gems 6100 manufactured by Gens Sensors, Inc. of Plainville, Conn.; the Dynisco PT386 or PT390 manufactured by Dynisco, Inc. of Sharon, Mass.; and the Viatran 709, 571 or 70 series manufactured by the Viatran Corporation of Grand Island, N.Y. The specific transducer employed is not critical to the techniques of the disclosed embodiment but should preferably have a response time of 20 ms or less.

The primary transducer 163 converts the received, combined pressure pulses 167 and 169 into a primary electrical signal 400, and the reference transducer 165 converts the received pressure pulse 167 into a secondary electrical signal 402. The primary transducer 163 and the reference transducer 165 provide the primary signal 400 and the reference signal 402 respectively to a signal conditioning box 175. The signal conditioning box 175, which includes analog anti-alias filters 177, converts the 4–20 mA primary and reference signals 400 and 402 from the transducers 163 and 165 to a suitable voltage for data acquisition cards (not shown) in the computing system C. The signal conditioning box 175 provides an anti-aliased primary signal 404 and an anti-aliased secondary signal 406 respectively to a primary channel 177 and a secondary channel 179 respectively of an adaptive noise canceler (ANC) 181. The ANC 181 is described in more detail below in FIG. 4. In the disclosed embodiment, the primary transducer 163 is preferably placed between 50 and 300 feet from and downstream of the desurger 153; and the reference transducer 165 is within 20 feet downstream of or, optimally, on the desurger 153.

Figure 3:
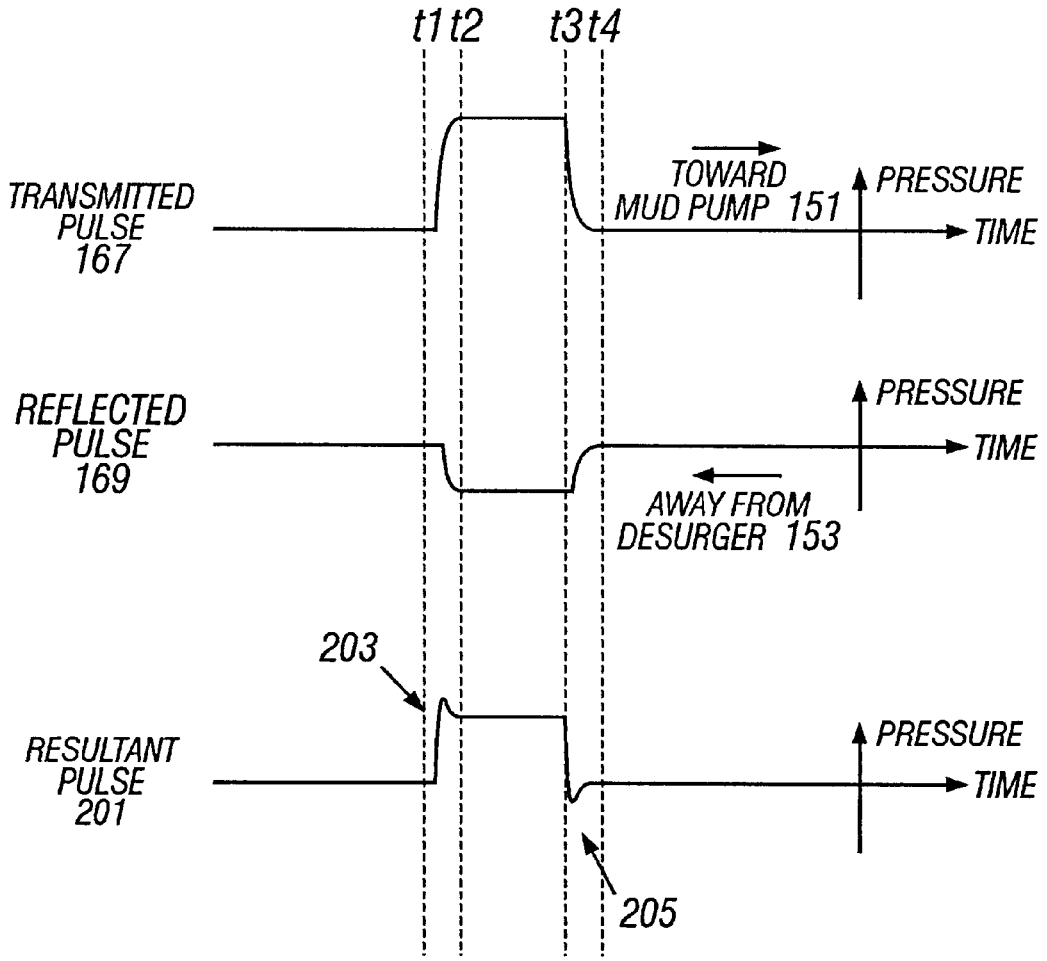
FIG. 3 illustrates a transmitted pulse, a reflected pulse, and a resultant pulse measured at a rig floor transducer.

Turning now to FIG. 3, illustrated is a diagram of three pressure pulses received at the primary transducer 163 plotted as a function of pressure over time. The first pressure pulse is the transmitted pulse 167 that travels through the downward traveling mud flow 155 (FIG. 2) in an upstream direction, or toward the mud pump 151. The second pressure pulse is the reflected pulse 169 that travels in a downstream direction, or away form the desurger 153. The reflected pulse 169 is created when the transmitted pulse 167 reaches the desurger 153 and is reflected back down hole.

The transmitted pulse 167 begins at a time t1 and ends at a time t3. The reflected pulse 169 begins at a time t2 and ends at a time t4 and has less amplitude then the transmitted pulse 167. The difference in amplitude between the transmitted pulse 167 and the reflected pulse 169 can be attributed to the attenuation of the transmitted pulse 167 as it travels upstream, energy lost when the transmitted pulse 167 is reflected by the desurger 153, and the attenuation in the resulting reflected pulse 169 as it travels back downstream. The difference between the beginning of the transmitted pulse at time t1 and the beginning of the reflected pulse 169 at time t2 represents an amount of travel time it takes for the transmitted pulse 167 to travel upstream from the primary transducer 163 to the desurger 153, become the reflected pulse 169, and travel back downstream to the primary transducer 163. The difference between the end of the transmitted pulse 167 at time t3 and the end of the reflected pulse 169 at t4 represents approximately the same travel time.

The third exemplary pulse is a resultant pulse 201 that represents the sum of the transmitted pulse 167 and the reflected pulse 169. Note that the reflected pulse 169 arrives at the primary transducer 163 later than the transmitted pulse 167 and is of a smaller magnitude. As a result of the difference in time between time t1 and time t2, the resultant pulse 201 has a peak 203 at the beginning edge. As a result of the difference between time t3 and time t4, the resultant pulse 201 also has a dip 205 at the trailing edge.

As noted above, the reference transducer 165 receives the transmitted pulse 167 and, because it is either near or on the desurger 153, almost none of the reflected pulse 169. The techniques of the disclosed embodiment employ the resultant pulse 201 received at the reference transducer 165, as well as data from the processing of preceding pulses, to process the transmitted pulse 167. The sharp edges of the resultant pulse 201 have a frequency that is dependant on the distance between the primary and reference transducers 163 and 165 and are highly correlated with the rising and falling edges of the transmitted and reflected pulses 167 and 169. Further, the sharp edges are time synchronized with the transmitted pulse 167, thus providing accurate clock tracking and recovery, greater signal amplitude and a better S/N ratio, leading to more reliable signal detection and higher transmission rates. Thus, the resultant pulse 201 is more sharply defined than the transmitted pulse 167 or the reflected pulse 169, and MWD/LWD data can be transmitted at higher data rates than in either a single transducer MWD/LWD system or in a two-transducer MWD/LWD system that does not employ an ANC 181.

Figure 4:
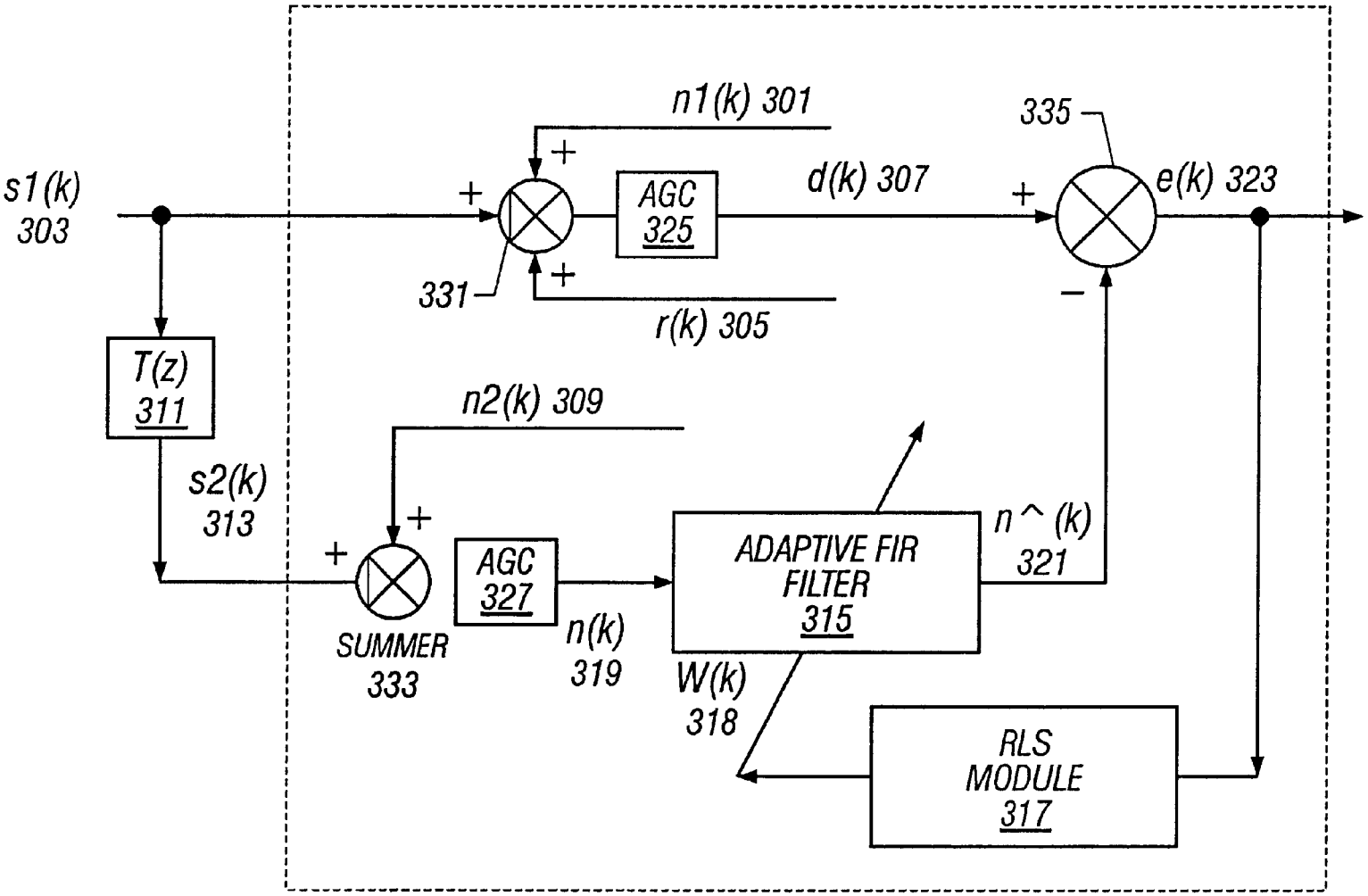
FIG. 4 is a block diagram of an adaptive noise canceler (ANC) of the described embodiment.

Turning now to FIG. 4, illustrated is an exemplary ANC 181 of the disclosed embodiment. A primary input signal d(k) 307, which corresponds to the primary signal 400 (FIG. 2), is the sum of a s1(k) signal 303, which is a transmitted MWI/LWD signal plus drilling noise such as mud pump 101 noise and noise generated by the rotation of the drillpipe 157 (FIG. 2), plus a n1(k) signal 301, which represents electronic/random noise such as that added due to the A/D converter 18 (FIG. 1*b*), and a reflected MWD/LWD r(k) signal 305 corresponding to the MWD/LWD signal s1(k) 303. A summer 331 represents the combination of the s1(k) signal 303, the n1(k) signal 301 and the r(k) signal 305 to form the d(k) signal 307 and does not necessarily represent a physical device. The d(k) signal 307 is processed by an automatic gain control (AGC) device 325, which adjusts the d(k) signal 307 to a level appropriate for further processing, and is then passed to a summer 335, described in more detail below. If a sr(k) signal (not shown) is set equal to the sum of the s1(k) signal 303 and the r(k) signal 305, the relationship of the s1(k) signal 303, the r(k) signal 305, the n1(k) signal 301 and the sr(k) signal can be described as follows:

$$d(k) = s1(k) + r(k) + n1(k)$$

$$= sr(k) + n1(k).$$

The s1(k) signal 303 goes through a T(z) transformation 311 which produces a s2(k) signal 313. The T(z) transformation 311 represents a physical conversion of the s1(k) signal 303 from a current loop into voltage for data acquisition cards (not shown) of the computing system C (FIG. 1*b*) and, in the disclosed embodiment, includes anti-aliasing filtering. The T(z) transformation 311 also represents a physical transformation of the s1(k) signal 303 such as effects caused by the length of and number of joints in the drillpipe 157.

A secondary input signal n(k) 319, which corresponds to the reference signal 402 (FIG. 2), is the output of a summer 333, which combines the output of the T(z) transformation 311, or a s2(k) signal 313, and a n2(k) noise signal 309 that represents electronic/random noise such as that introduced by the A/D converter 18. Like the summer 331, the summer 333 does not necessarily represent a physical device. The n(k) signal 319 is passed by the summer 333 to an AGC device 327, which adjusts the level of the n(k) signal 319 to a level appropriate for further processing, and then to an adaptive tapped delay line finite impulse response (FIR) filter 315, which is described in more detail below. The n(k) signal 319 can be described as follows:

$$n(k)=s2(k)+n2(k).$$

The reference signal n(k) 319 is "weighted" by the FIR filter 315 using a set of coefficients W(k) 318. The coefficients W(k) 318 are calculated by means of a recursive least squares (RLS) module 317, described in more detail below. The output of the FIR filter 315 is a weighted n(k) signal 319, or a n^(k) signal 321. The n^(k) signal 321 is subtracted from the primary signal d(k) to give an estimate of the ANC output, e(k). The calculation of e(k) is done in such a way as to minimize the expected square value of e(k). The n^(k) signal 321 can be described as follows:

$$\begin{aligned} n\hat{}(k) &= n(k) * W(k) \\ &= s2'(k) + n2'(k) \end{aligned}$$

where the symbol '*' refers to a convolution corresponding to the weighting using the W(k) coefficients 318. The s2'(k) signal (not shown) and the n2'(k) signal (not shown) represent the individual weighting of the s2(k) signal and the n2(k) signal respectively.

The n^(k) signal 321 is subtracted from the primary input signal d(k) 307 by the summer 335 to give an estimate of an ANC error signal e(k), or an ANC output signal, 323, as shown below:

$$\begin{aligned} d(k) - n\hat{}(k) &= sr(k) + n1(k) - n(k) * W(k) \\ &= s1(k) + r(k) + n1(k) - s2'(k) - n2'(k) \\ &= (s1(k) + r(k) - s2'(k)) + (n1(k) - n2'(k)) \\ &= s(k) + n(k) = e(k) \end{aligned}$$

where s(k) or e(k) is an estimate of a spike signal 505 (FIG. 5) described as follows:

$$s(k)\approx s1(k)+r(k)-s2'(k),$$

and n(k) 319, a random uncorrelated noise is described as follows:

$$n(k)=n1(k)-n2'(k).$$

A calculation of e(k) 323 is done in such a way as to minimize the expected square of error e(k). Assuming there is no correlated spike frequency signal in the reference signal n(k) 319 and no correlation between the spike signal and noise signals n1(k) and n2(k), then $$\begin{aligned} E\{e(k)^2\} &= E\{(d(k) - n\hat{}(k))^2\} \\ &= \{(sr(k) + n1(k) - W(k) * n(k))^2\} \\ &= E\{sr(k)^2 + 2sr(k)n1(k) + n1(k)^2 - 2sr(k)(W(k) * n(k)) - \\ &\quad 2n1(k)(W(k) * n(k)) + (W(k) * n(k))^2\} \\ &= E\{sr(k)^2\} + E\{n1(k)^2\} - 2E\{sr(k)(W(k) * n(k))\} + \\ &\quad E\{(W(k) * n(k))^2\} \\ &\cong E(s(k)^2) - 2E\{sr(k)(W(k) * n(k))\} \end{aligned}$$

where E{.} denotes an expectation or statistical average, the symbol '*' denotes convolution, as described above. The W(k) coefficients 318 are calculated using a RLS-type algorithm by the RLS module 317 based upon an e(k) signal 323 corresponding to previous transmitted pulses. Since $E\{s(k)^2\}$ is constant, minimization of the error square $E\{e(k)^2\}$ reduces to a minimum squared error cancellation of sr(k) by W(k)*n(k).

Therefore, the W(k) coefficients 318 are adjusted to minimize the mean square value of the e(k) signal 323. The W(k) coefficients 318 are calculated using an iterative procedure according to the steepest-descent (gradient) algorithm and the following:

$$W(k)=W(k-1)+\Delta e(k)\underline{n}(k)$$

where W(k−1) represents a set of coefficients immediately preceding the W(k) coefficients 318 at the k−1-th iteration and Δ is a positive number chosen small enough to ensure the convergence of the iterative procedure. The $\underline{n}$(k) vector is a set of data points measured at the secondary input for k=0, 1, 2, . . . , N, and N is a length of the adaptive FIR filter 315.

The equation directly above represents a basic mean square error (MSE) algorithm or what basically is referred to as a Least Mean Square (LMS) algorithm for adjusting or updating the FIR filter 315 coefficients, which represent the phase and magnitude of linearly correlated counter parts of the primary signal d(k) 307 and the reference signal n(k) 319. There are several variations of the LMS algorithm and, in the alternative, other variations of the LMS algorithm may be applied. However, due to the slow convergence of the LMS algorithm, the RLS module 317 of the disclosed embodiment uses an RLS-type algorithm based on a least square approach that processes the received data to minimize a quadratic performance index. Minimization of the quadratic performance index provides a "fit" between the primary signal d(k) 307 and the reference signal (n(k) 319. This least square algorithm is known to those with knowledge in the art as the RLS, or Kalman, algorithm. Variations of the RLS, or Kalman, algorithm such as the Fast Recursive Least Square algorithm may also be used to calculate and adjust the W(k) coefficients 318. It should be understood that other algorithms derived or related to the RLS algorithm (i.e. RLS-type algorithms) can be used. The calculation the W(k) coefficients 318 can be summarized as follows:

$$e(k)=d(k)-n\hat{}(k)$$

$$W(k)=W(k-1)+K(k)e(k)$$

where K(k) is known as a Kalman gain vector. In the alternative, other methods such as a fast least squares algorithm may be used to calculate the gain vector. In the disclosed embodiment, the Kalman gain vector is calculated according to the following:

$$K(k)=1/(w+\mu(k))R^{-1}(k-1)\underline{n}(k)=1/(w+\mu(k))P(k-1)\underline{n}(k),\ P(k)=R^{-1}(k)$$

where, $\mu(k)=\underline{n}'(k)R^{-1}(k-1)\underline{n}(k)$, $\underline{n}'(k)$=the transpose of the vector $\underline{n}(k)$, R(k)=the correlation matrix for $\underline{n}2(k)$ and is given by:

$R(k)=\Sigma_{i=0}^{k}w^{k-i}\underline{n}(k)\underline{n}'(k)$ w=weighting factor (0<w<1).

R(k) can be computed recursively as:

$$R(k)=w\ R(k-1)+\underline{n}(k)\underline{n}'(k).$$

An inverse correlation matrix P(k) can be expressed using a matrix inversion lemma and may be computed recursively as:

$$P(k)=(1/w)[P(k-1)-K(k)\underline{n}'(k)P(k-1)].$$

The W(k) coefficients 318 calculated above find an estimate n^(k) 321 by convolving the secondary input with the coefficients W(k) 318 obtained in accordance with the equation (n^(k)=n(k)*W(k)) every time a data point is collected. The FIR filter 315 output, n^(k) 321, is then subtracted from the primary input signal d(k) 307 by the summer 335 to obtain the e(k) signal 323 which is passed then for further processing. In this manner, the ANC 181 is used to isolate spike frequencies and remove signal interference that might have resulted due to the drilling process and is common to both the primary signal 163 and the reference signal 165.

Figure 5:
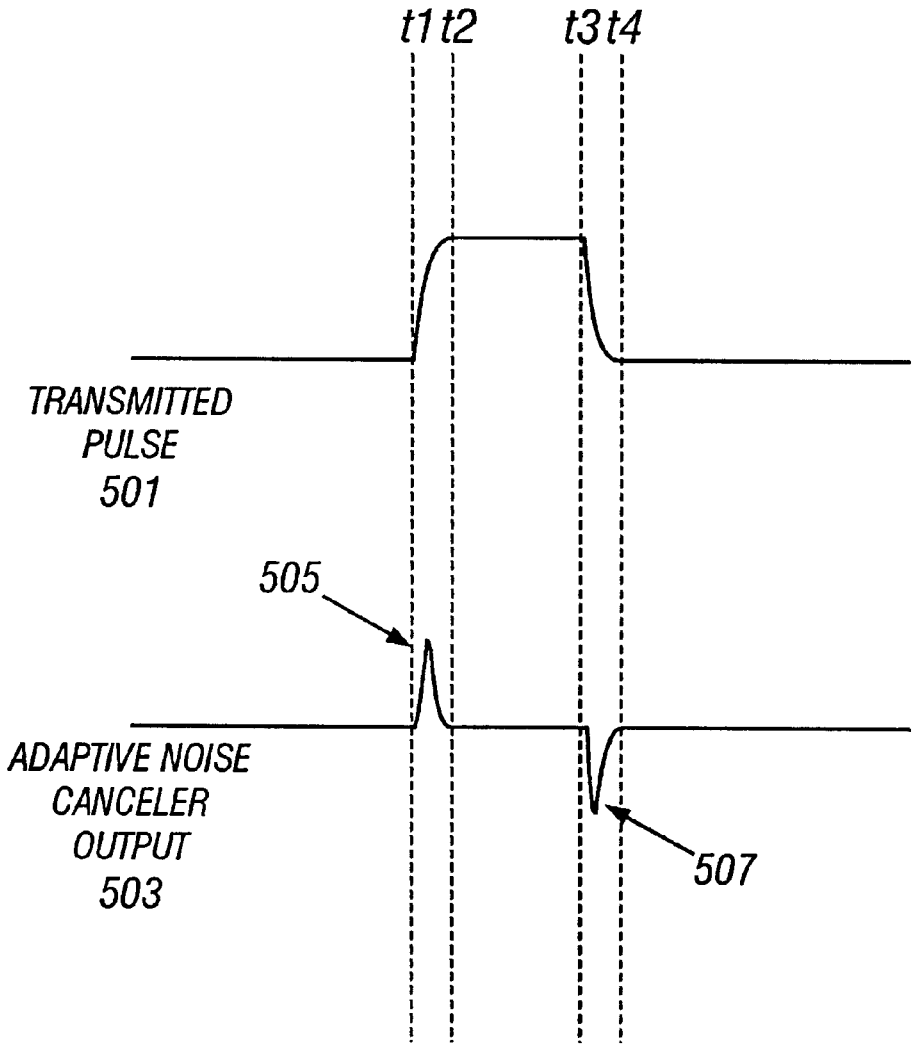
FIG. 5 is a graphical representation showing an ideal transmitted pulse and the respected ideal ANC output signal (spike) as described in the preferred embodiment.

Turning now to FIG. 5, illustrated is a timing diagram that includes an exemplary transmitted pulse 501 similar to the transmitted pulse 167 (FIG. 3) and an exemplary ANC output pulse 503. For the illustrated pulses, pressure is plotted as a function of time. Like the resultant pulse 201 (FIG. 3), the ANC output pulse 503 includes a peak 505 at the leading edge and a dip 507 at the trailing edge. However, as a result of the techniques of the disclosed embodiment, the peak 505 and the dip 507 are more pronounced than the peak 203 and the dip 205, respectively. This result enables MWD/LWD information to be transmitted more accurately and at a higher transmission rate than is possible by using a simple signal addition as illustrated in FIG. 3 or by employing a band-pass or high-pass filtering scheme. Sharply defined peaks and dips enable MWD/LWD information to be transmitted more accurately and at higher transmission rates because the MWD/LWD information is, in the disclosed embodiment, encoded within the pulse position of the transmitted pulse 501. Thus, a sharply defined pulse is less likely to be obscured in the noisy environment of a drilling operation than a pulse in a conventional MWD/LWD signal system and the amplitude of the transmitted pulse 501 is not effected by the pulse width or the desurger 153.

Figure 6A:
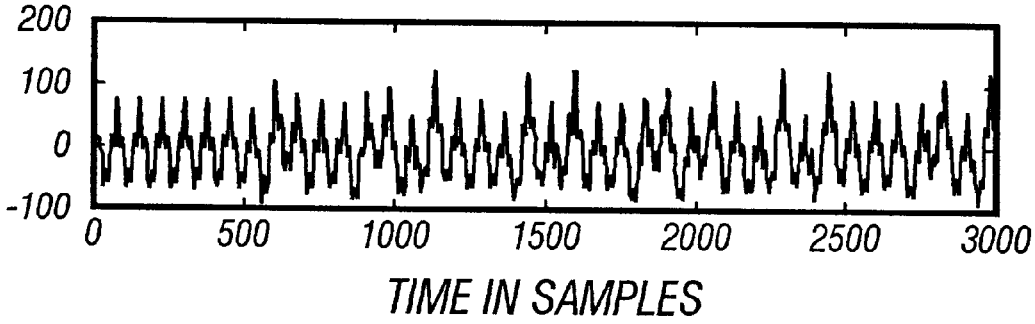
FIGS. 6 and 7 show transmitted pulses measured at both transducers under actual well drilling conditions and the resultant output of the ANC.
Figure 6B:
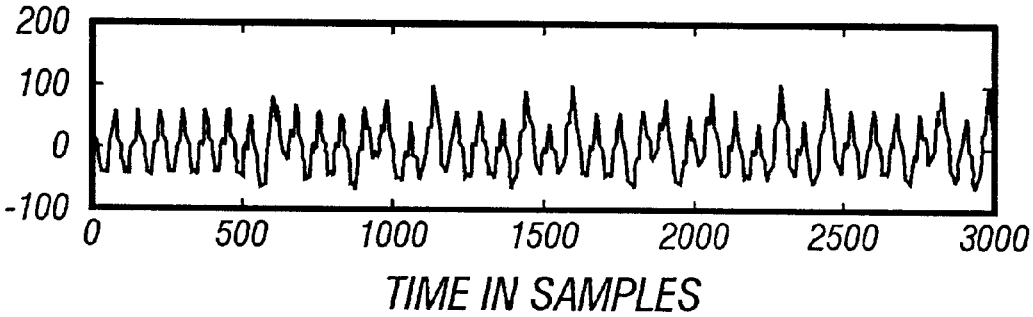
Figure 6C:
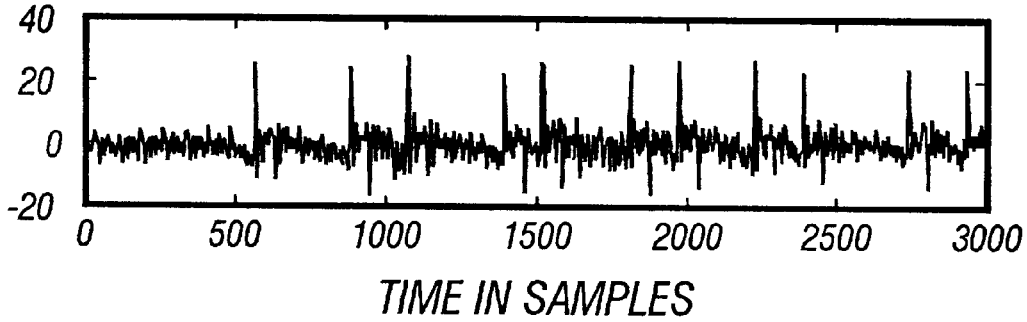
Figure 7:
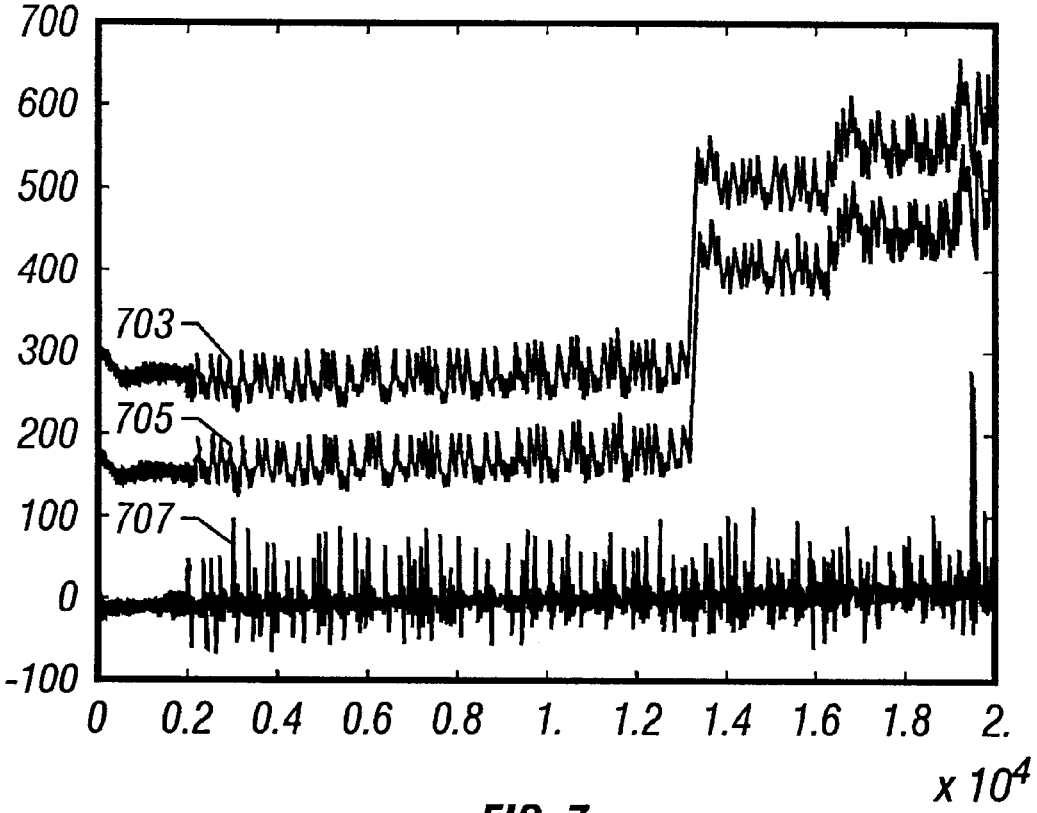

FIGS. 6 and 7 are diagrams showing additional exemplary inputs and outputs of the ANC 181 of the disclosed embodiment plotted in terms of pressure as a function of time. In FIG. 6, a primary input signal 307 and a reference input signal 319 are processed by the ANC 181 (FIG. 2) to produce a ANC output signal 401. Note the sharply defined peaks and dips in the ANC output signal 40 similar to the sharply defined peaks and dips of the ANC output signal 503 in FIG. 5. FIG. 7 shows an exemplary dual-channel MWD/LWD system. Like FIG. 6, a primary input signal 703 and a reference signal 705 are processed by the ANC 181 to produce a ANC output signal 707. The ANC output signal 707 also includes sharply defined peaks and dips. Use of such an ANC output signal allows for reliable recovery of MWD/LWD data.

The foregoing disclosure and description of the various embodiments are illustrative and explanatory thereof, and various changes in the descriptions and attributes of the ANC, the organization of the components, and the order and timing of steps taken, as well as in the details of the illustrated system may be made without departing from the spirit of the invention. While an exemplary system is described in the context of a petroleum drilling system, it shall be understood that a system according to the described techniques can be implemented in a variety of other drilling systems that employ MWD/LWD techniques.

What we claim is:

1. A method of detecting telemetry in drilling fluid during drilling operations, comprising the steps of:

generating a drilling fluid pressure pulse in a bore hole downstream of a position of a primary transducer creating an upstream traveling, transmitted pulse;

detecting a combination of the transmitted pulse and a reflected pulse corresponding to the transmitted pulse at the primary transducer and producing a primary signal based upon the detected combination of the transmitted pulse and the detected reflected pulse;

detecting the transmitted pulse at a reference transducer upstream from the position of the primary transducer and producing a secondary signal based upon the detected transmitted pulse; and generating an adaptive noise canceler (ANC) output signal based upon a difference between the primary signal and the secondary signal.

2. The method of claim 1, the generating step comprising the step of:

adaptive noise canceling correlated portions between the primary signal and the secondary signal by calculating a fit between the primary signal and the secondary signal to produce the ANC output signal based on uncorrelated portions between the primary signal and the secondary signal.

3. The method of claim 1, wherein the ANC output signal comprises an ANC output pulse with a sharply defined peak at a leading edge of the ANC output pulse and a sharply defined dip at a trailing edge of the ANC output pulse.

4. The method of claim 1, wherein the reference transducer is located at a point where the transmitted pulse is reflected.

5. The method of claim 1, wherein the ANC output signal is also generated based upon a difference between a previous primary signal at the primary transducer and a previous secondary signal at the reference transducer.

6. The method of claim 1, the generating step comprising the steps of:

calculating a set of weighting coefficients based upon the fit; and generating the ANC output signal based upon the set of weighting coefficients.

7. The method of claim 2, wherein the weighting coefficients are calculated by means of a least squares algorithm.

8. The method of claim 2, wherein the weighting coefficients are calculated by means of a fast recursive least squares (RLS) type algorithm.

9. An adaptive noise canceler (ANC) for use in a Measurement-While-Drilling/Logging-While-Drilling (MWD/LWD) system for telemetry detection, comprising:

a recursive least squares (RLS) module to calculate a fit based upon a difference between a primary signal corresponding to a combination of a transmitted pulse and a reflected pulse detected at a primary transducer and a secondary signal corresponding to the transmitted pulse detected at a reference transducer upstream from a position of the primary transducer; and an adaptive finite impulse response (FIR) filter to generate an ANC output signal based upon the difference between the primary signal and the secondary signal.

10. The ANC of claim 9, wherein the adaptive FIR filter adaptive noise cancels correlated portions between the primary signal and the secondary signal by calculating a fit between the primary signal and the secondary signal with a set of weighting coefficients to produce the ANC output signal based on uncorrelated portions between the primary signal and the secondary signal.

11. The ANC of claim 10, wherein the fit is also based upon a fit between a difference between a previous primary signal corresponding to a previously transmitted pulse and a previous secondary signal corresponding to the previously transmitted pulse.

12. The ANC of claim 9, wherein the ANC output signal comprises:

an ANC output pulse with a sharply defined peak at a leading edge of the ANC output pulse; and a sharply defined dip at a trailing edge of the ANC output pulse.

13. The ANC of claim 9, further comprising:

weighting coefficient generation logic for computing a set of weighting coefficients based upon the fit between the primary signal and the secondary signal calculated by the RLS module; and weighting coefficient application logic for applying the set of weighting coefficients for generation of the ANC output signal by the adaptive FIR filter.

14. The ANC of claim 13, wherein the set of weighting coefficients is based upon phase and amplitude of the primary signal and the secondary signal.

15. The ANC of claim 9, wherein the fit between the primary signal and the secondary signal is based upon a least squares fit.

16. The ANC of claim 15, wherein the least squares fit is calculated by means of a fast recursive least squares (RLS) type algorithm.

17. A computer-readable medium used for storing adaptive noise cancellation (ANC) software for telemetry detection, the ANC software comprising:

code for detecting at a primary transducer a combination of a transmitted pulse and a reflected pulse and producing a primary signal;

code for detecting the transmitted pulse at a reference transducer upstream from a position of the primary transducer and producing a secondary signal;

code for calculating a fit between the primary signal and the secondary signal to create a linear relationship between a first plurality of points of the primary signal and a second plurality of points of the secondary signal; and code for creating an adaptive noise cancellation (ANC) output signal based upon the difference between the primary signal and the secondary signal.

18. The computer-readable medium of claim 17, wherein the code for creating comprises:

code for adaptive noise canceling correlated portions between the primary signal and the secondary signal by calculating a fit between the primary signal and the secondary signal to produce the ANC output signal based on uncorrelated portions between the primary signal and the secondary signal.

19. The computer-readable medium of claim 18, further comprising:

code for calculating a set of weighting coefficients based upon the fit between the primary signal and the secondary signal; and code for adjusting the ANC output signal based upon the set of weighting coefficients.

20. The computer-readable medium of claim 18, wherein the fit is also based upon a fit between a previous primary signal and a corresponding previous secondary signal.

21. The computer-readable medium of claim 18, wherein the fit is based upon phase and amplitude of the primary signal and the secondary signal.

22. The computer-readable medium of claim 19, wherein the calculation of the set of weighting coefficients is performed by means of a least squares algorithm.

23. The computer-readable medium of claim 22, wherein the least squares algorithm is a fast recursive least squares (RLS) type algorithm.

* * * * *